US010125642B1

(12) United States Patent
Godbold, Jr.

(10) Patent No.: US 10,125,642 B1
(45) Date of Patent: Nov. 13, 2018

(54) LENGTH ADJUSTABLE PUSHROD DEVICE FOR INTERNAL COMBUSTION ENGINES

(71) Applicant: Competition Cams, Inc., Memphis, TN (US)

(72) Inventor: William E. Godbold, Jr., Memphis, TN (US)

(73) Assignee: Competition Cams, Inc., Memphis, TN (US)

( * ) Notice: Subject to any disclaimer, the term of this patent is extended or adjusted under 35 U.S.C. 154(b) by 75 days.

(21) Appl. No.: 15/286,671

(22) Filed: Oct. 6, 2016

(51) Int. Cl.

| | |
|---|---|
| ***F01L 13/00*** | (2006.01) |
| ***F01L 1/14*** | (2006.01) |
| ***F01L 1/10*** | (2006.01) |
| ***F01L 1/22*** | (2006.01) |
| *F01L 1/18* | (2006.01) |
| *F01L 1/46* | (2006.01) |

(52) U.S. Cl.
CPC ..... *F01L 1/146* (2013.01); *F01L 1/10* (2013.01); *F01L 1/22* (2013.01); *F01L 13/0031* (2013.01); *F01L 1/181* (2013.01); *F01L 1/46* (2013.01)

(58) Field of Classification Search
CPC ... F01L 1/146; F01L 1/181; F01L 1/46; F01L 13/0031
USPC ..... 123/90.39, 90.48, 90.61
See application file for complete search history.

(56) References Cited

U.S. PATENT DOCUMENTS

| | | | | | |
|---|---|---|---|---|---|
| 3,964,455 | A * | 6/1976 | Brown | F01L 1/2422 | 123/90.16 |
| 4,589,384 | A * | 5/1986 | Ott | F01L 1/245 | 123/90.55 |
| 4,829,949 | A * | 5/1989 | Holmer | F01L 1/10 | 123/90.16 |
| 5,095,862 | A * | 3/1992 | Murphy | F01L 1/20 | 123/90.61 |
| 5,492,085 | A * | 2/1996 | Tiller | F01L 1/146 | 123/90.35 |
| 5,507,100 | A * | 4/1996 | Magnet | F01L 1/146 | 123/90.61 |
| 5,791,307 | A * | 8/1998 | Helmin | F01L 1/08 | 123/90.63 |
| 6,854,436 | B1 * | 2/2005 | English | F01L 1/146 | 123/90.61 |
| 7,644,694 | B2 | 1/2010 | Hanold et al. | | |
| 2017/0122148 | A1 * | 5/2017 | Katta | F01L 13/0031 | |

* cited by examiner

*Primary Examiner* — Jorge Leon, Jr.
(74) *Attorney, Agent, or Firm* — Nelson Mullins Riley & Scarborough LLP

(57) ABSTRACT

An improved length adjustable pushrod device for disposition in an internal combustion engine between a rocker arm and a cam shaft comprises a base rod section having a hollow interior extending between an inward seat within the hollow interior and an outward opening at one end of the base rod section and an extension rod section having one end thereof insertable telescopically through the outward opening at the one end of the base rod section and into the hollow interior thereof. The base and extension rod sections define a collective length of the pushrod device when assembled. At least one shim is provided for selective disposition in the hollow interior of the base rod section between the seat thereof and the one end of the extension rod section for selectively varying the collective assembled length of the base and extension rod sections.

5 Claims, 3 Drawing Sheets

LENGTH ADJUSTABLE PUSHROD DEVICE FOR INTERNAL COMBUSTION ENGINES

FIELD OF THE INVENTION

The present invention relates generally to internal combustion engines and, more particularly, to pushrods which interact between a rocker arm and a cam shaft in automobile engines.

BACKGROUND OF THE INVENTION

In the operation of internal combustion automotive engines, the length of the pushrods which connect between the rocker arms and the cam shaft has a direct affect on the timing of and wear on the valvetrain and, in turn, on engine performance and longevity, especially in high performance engines. Particularly when engines may be retrofitted with aftermarket cam shafts, rocker arms and valves, the installation of pushrods of a correct length is often critical to achieving full performance of the valvetrain.

Aftermarket pushrods are available in varying lengths and widths, along with pushrod length checking tools. In additional, pushrods are known to include threaded connections to the rocker arms as a means of attaching the pushrod to the rocker arm with the capability to make fine adjustments to the pushrod length via the threaded connection.

A disadvantage of such pushrod assemblies is that the body of the rocker arm must be sufficiently large to accommodate and support the threaded connection which increases the overall weight of such assembly and correspondingly increases the moment of inertia of the rocker arm which, in turn, detracts from valvetrain stability and dynamics. Accordingly, a need exists for an optimized configuration of pushrod adjustment without a negative affect on valvetrain dynamics.

SUMMARY OF THE INVENTION

The present invention seeks to address such need by providing an improved form of length adjustable pushrod device for disposition in an internal combustion engine between a rocker arm and a cam shaft. Briefly summarized, the pushrod device of the present invention comprises a base rod section having a hollow interior extending between an inward seat within the hollow interior and an outward opening at one end of the base rod section and an extension rod section having one end thereof insertable telescopically through the outward opening at the one end of the base rod section and into the hollow interior thereof. In this manner, the base and extension rod sections define a collective length of the pushrod device when assembled. At least one shim is provided for selective disposition in the hollow interior of the base rod section between the seat thereof and the one end of the extension rod section for selectively varying the collective assembled length of the base and extension rod sections.

Preferably, each of the base and extension rod sections is of an elongated configuration. A second end of the extension rod section is configured for assembly with the rocker arm and a second end of the base rod section is configured for assembly with a tappet device for engagement with the cam shaft.

In a contemplated embodiment of the invention, a set of multiple shims is provided for selective disposition individually or in combinations in the hollow interior of the base rod section for selectively establishing multiple fine incremental length variations of the collective assembled length of the base and extension rod sections.

The invention further contemplates the provision of a set of multiple extension rod sections for selective assembly of any individual one thereof with the base rod section for selectively establishing multiple coarse length variations of the collective assembled length of the base and extension rod sections.

DETAILED DESCRIPTION OF THE INVENTION

Figure 4:
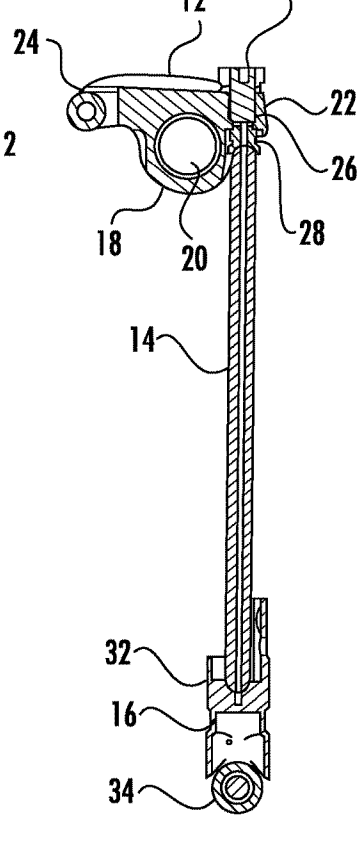
FIG. 4 Prior Art
FIG. 4 is a lengthwise cross-sectional view thereof, taken along line 4-4 of FIG. 3.
Figure 3:
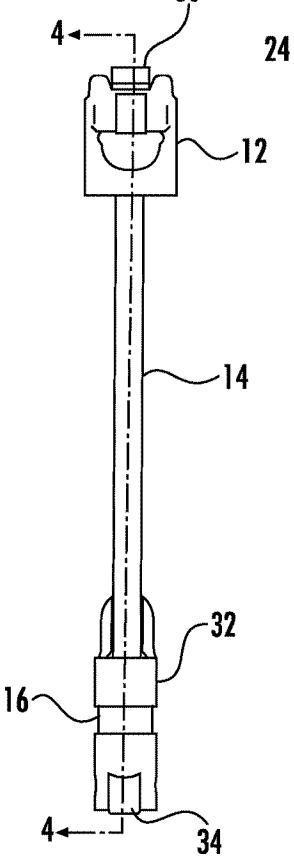
FIG. 3 Prior Art
FIG. 3 is a front elevational view thereof.
Figure 2:
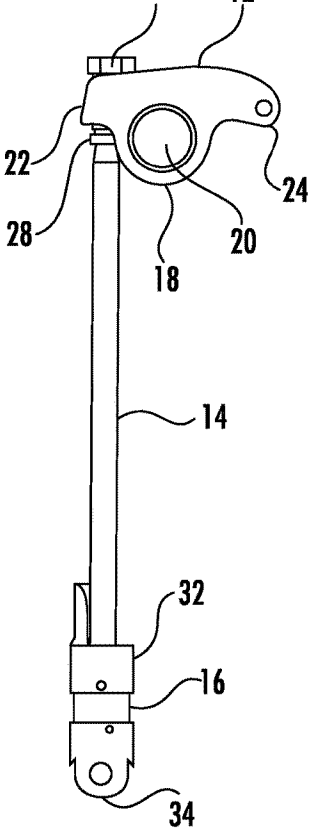
FIG. 2 Prior Art
FIG. 2 is a side elevational view thereof.
Figure 1:
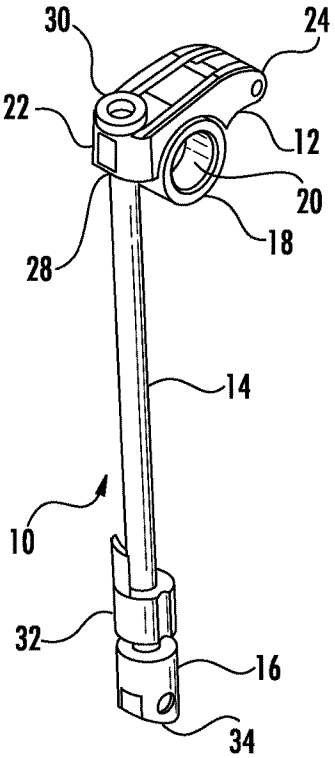
FIG. 1 Prior Art
FIG. 1 is a perspective view of a representative rocker arm and pushrod assembly according to the prior art.
Figure 8:
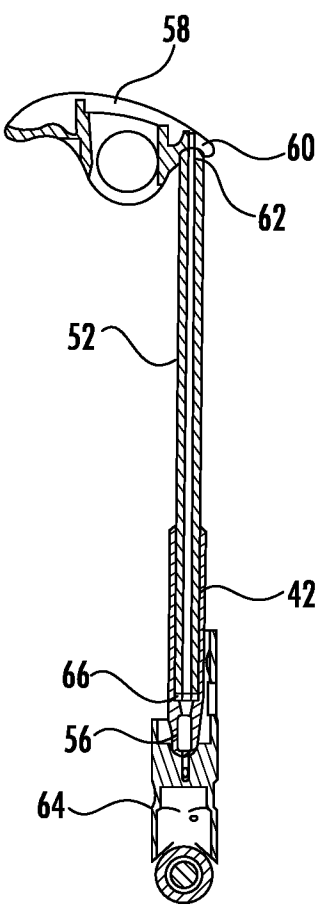
FIG. 8 is a lengthwise cross-sectional view thereof, taken along line 8-8 of FIG. 7.
Figure 7:
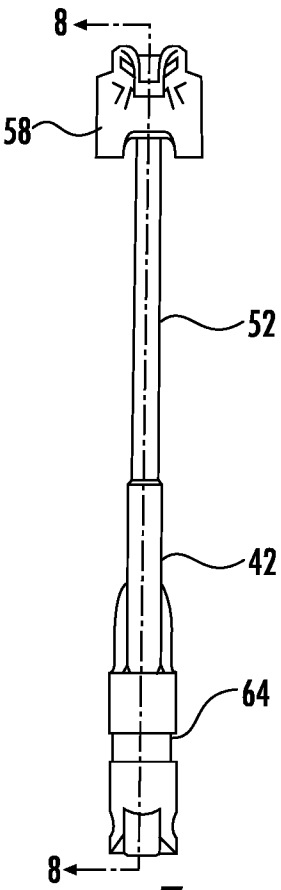
FIG. 7 is a front elevational view thereof.
Figure 6:
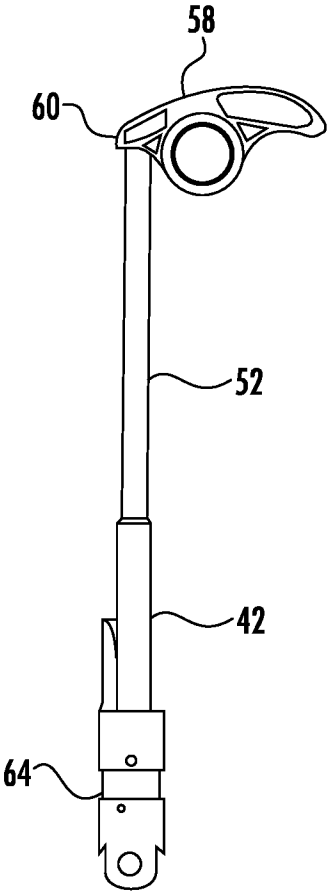
FIG. 6 is a side elevational view thereof.
Figure 5:
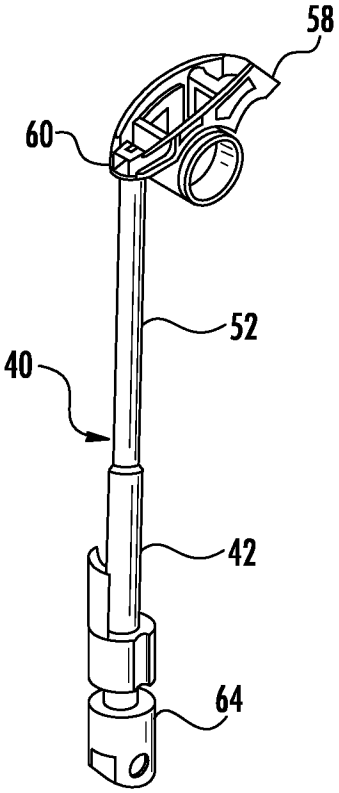
FIG. 5 is a perspective view of a rocker arm and pushrod assembly according to a contemplated embodiment of the present invention.

Referring now to the accompanying drawings and initially to FIGS. 1-4, a representative example of a known conventional form of rocker arm and pushrod assembly in an automobile engine is depicted generally at 10 and basically comprises a rocker arm 12, a pushrod 14, and a tappet 16. The rocker arm 12 comprises a central hub portion 18 having a circular bore 20 formed laterally therethrough for mounting on a rocker shaft (not shown), with a first arm portion 22 extending outwardly from one side of the hub portion 18 for attachment to the pushrod 14, and a second arm portion 24 extending outwardly from the opposite side of the hub portion 18 for engagement with a valve (not shown) movably disposed in the cylinder head (also not shown) of the engine.

The pushrod 14 is a linear elongated cylindrical rod of narrow diameter mounted at its upper end in a receiving bore 26 in the arm portion 22 of the rocker arm 12 via an adjustment screw 28 disposed in a lower end of the bore 26 and attached to the upper end of the pushrod 14, and a jam nut 30 extending into the bore 26 from the upper side of the arm portion 22 into threaded engagement with the adjustment screw 28. The threaded connection of the jam nut 30 and the adjustment screw 28, enable a degree of lengthwise extension or retraction of the pushrod 14 as necessary to achieve a desired length of the pushrod 14. The lower end of the pushrod 14 is received in a collar portion 32 at the upwardly facing end of the tappet 16. The lower end of the tappet 16 is fitted with a roller 34 for following engagement with a cam lobe on the camshaft of the engine (not shown).

As persons skilled in the art are aware and recognize, this known form of assembly of rocker arm 12 and pushrod 14, while providing an effective means for length adjustment of the pushrod 14, suffers an increased moment of inertia due to presence of the jam nut 30 and adjustment screw 28 and the necessary enlargement of the body of the rocker arm 12 to accommodate the jam nut 30 and adjustment screw 28.

Figure 10:
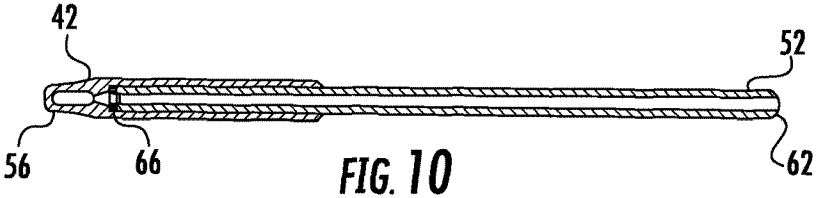
FIG. 10 is a lengthwise cross-sectional view of the pushrod device of FIG. 9, taken along line 10-10 thereof.
Figure 9:
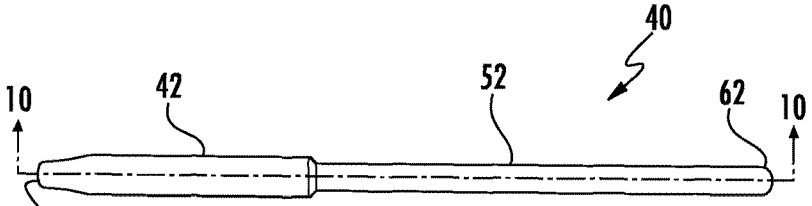
FIG. 9 is a side elevational view of the pushrod device of FIGS. 5-8, in assembled form.
Figure 11:
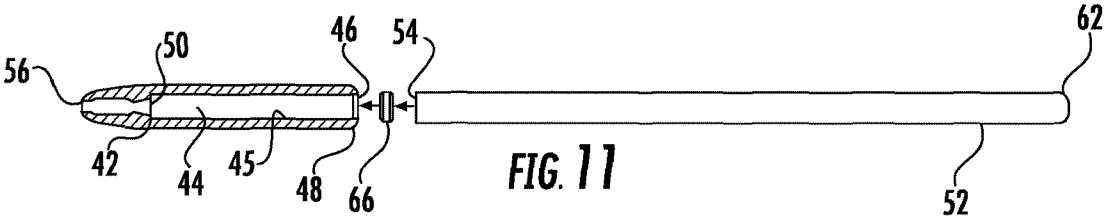
FIG. 11 is an exploded view of the pushrod device of FIGS. 9 and 10, partially in cross-section and partially in side elevation.

These issues are overcome by the improved form of pushrod device provided by the present invention, as depicted in FIGS. 5-11. As shown in FIGS. 9-11, the present pushrod device, indicated overall at 40, comprises a base rod section 42 and an extension rod section 52. The base rod section 42 is of an elongated, predominantly cylindrical configuration with a hollow interior 44 defined by a bore 45 which extends centrally within the base rod section 42 from an outward opening 46 at an upper end 48 of the base rod section 42 to a terminus forming an inward seat 50 within the hollow interior 44. The extension rod section 52 is also of an elongated, cylindrical configuration, but of a narrower diameter corresponding to the bore 45, such that one end 54 of the extension rod section 52 is insertable telescopically through the outward opening 46 and into the hollow interior 44 of the base rod section 42. In this manner, the base and extension rod sections 42, 52 define a collective length of the pushrod device when so assembled.

The lower, outward end 56 of the base rod section 42 is configured for assembly with a roller tappet 64 for engagement with a cam shaft (not shown) and the upper, outward end 62 of the extension rod section 52 is configured for connection to one arm portion 60 of a rocker arm 58, all as depicted in FIGS. 5-8.

At least one shim 66 is selectively disposed in the hollow interior 44 of the base rod section 42 in seated abutment against the seat 50 and with the end 54 of the extension rod section 52 fully inserted into end abutment against the shim or shims 66, thereby selectively adjusting the collective assembled length of the base and extension rod sections 42, 52.

Figure 13:
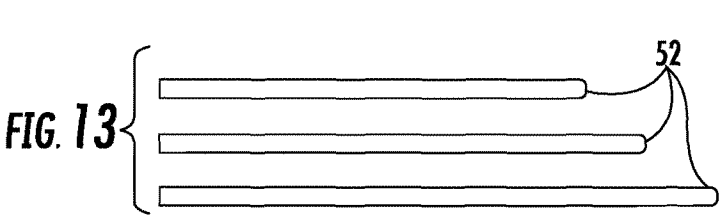
FIG. 13 depicts a representative set of extension rid sections for selective use in the pushrod device of FIGS. 5-11.
Figure 12:
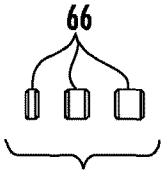
FIG. 12 depicts a representative set of shims for selective use in the pushrod device of FIGS. 5-11.

Preferably, a set of multiple extension rod sections 52 of differing lengths, as representatively depicted in FIG. 13, and a set of multiple shims 66, which may be of the same or differing axial dimensions as representatively depicted in FIG. 12, are provided to enable selective varying of the collective assembled length of the base and extension rod sections 42, 52. Selection from among the differing extension rod sections 52 enables multiple coarse length variations of the collective assembled length of the base and extension rod sections 42, 52 to be selectively established, while selective disposition of any individual shim 66 or two or more shims 66 in differing combinations in the hollow interior 44 of the base rod section 42 enables multiple fine incremental length variations of the collective assembled length of the base and extension rod sections 42, 52 to be established.

As may be seen in FIGS. 5-8, the length adjustment permitted by the pushrod device 40 eliminates any need for a jam nut and/or adjustment screw connection to the rocker arm 58, and in turn the rocker arm 58 may be fabricated of a more streamlined, less bulky configuration, as is depicted in the rocker arm 58 of FIGS. 5-8 as compared to the rocker arm of FIGS. 1-4. As a result, the rocker arm 58 may be configured to optimize its strength to weight ratio and to achieve a significantly lower moment of inertia with improved valvetrain dynamics allowing higher engine speeds with less stress on valvetrain components than in the prior art design of FIGS. 1-4.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A length adjustable pushrod device for disposition in an internal combustion engine between a rocker arm and a cam shaft, the pushrod device comprising a base rod section having a hollow interior extending between an inward seat within the hollow interior and an outward opening at one end of the base rod section, an extension rod section having one end thereof insertable telescopically through the outward opening at the one end of the base rod section and into the hollow interior thereof, the base and extension rod sections defining a collective length of the pushrod device when assembled, and a set of multiple shims for selective disposition individually or in combinations in the hollow interior of the base rod section between the seat thereof and the one end of the extension rod section for selectively establishing multiple fine incremental length variations of the collective assembled length of the base and extension rod sections.

2. The length adjustable pushrod device of claim 1, wherein a second end of the base rod section is configured for assembly with a tappet device for engagement with the cam shaft and a second end of the extension rod section is configured for assembly with the rocker arm.

3. The length adjustable pushrod device of claim 1, further comprising a set of multiple extension rod sections for selective assembly of an individual one thereof with the base rod section for selectively establishing multiple coarse length variations of the collective assembled length of the base and extension rod sections.

4. The length adjustable pushrod device of claim 1, wherein each of the base and extension rod sections is of an elongated configuration.

5. A length adjustable pushrod device for disposition in an internal combustion engine between a rocker arm and a cam shaft, the pushrod device comprising a base rod section having a hollow interior extending between an inward seat within the hollow interior and an outward opening at one end of the base rod section, a set of multiple extension rod sections each having one end thereof insertable telescopically through the outward opening at the one end of the base rod section and into the hollow interior thereof, the base and extension rod sections defining a collective length of the pushrod device when assembled, selective assembly of an individual one of the extension rod sections with the base rod section selectively establishing multiple coarse length variations of the collective assembled length of the base and extension rod sections, and at least one shim for selective disposition in the hollow interior of the base rod section between the seat thereof and the one end of the extension rod section for selectively varying the collective assembled length of the base and extension rod sections.

* * * * *